US007557642B2

(12) United States Patent
Hsu et al.

(10) Patent No.: US 7,557,642 B2
(45) Date of Patent: Jul. 7, 2009

(54) LOW SUPPLY VOLTAGE BANDGAP SYSTEM

(75) Inventors: Kuoyuan (Peter) Hsu, San Jose, CA (US); Maofeng Len, Union City, CA (US)

(73) Assignee: Taiwan Semiconductor Manufacturing Company, Ltd., Hsin-Chu (TW)

( * ) Notice: Subject to any disclaimer, the term of this patent is extended or adjusted under 35 U.S.C. 154(b) by 25 days.

(21) Appl. No.: 11/845,628

(22) Filed: Aug. 27, 2007

(65) Prior Publication Data

US 2009/0058511 A1 Mar. 5, 2009

(51) Int. Cl.
*G05F 3/16* (2006.01)

(52) U.S. Cl. ..... 327/539; 327/534

(58) Field of Classification Search ..... 327/534–540
See application file for complete search history.

(56) References Cited

U.S. PATENT DOCUMENTS 6,486,727 B1 11/2002 Kwong ..... 327/534
6,677,804 B2 1/2004 Pekny ..... 327/535
6,917,248 B2 7/2005 Nguyen ..... 311/117 R

*Primary Examiner*—Dinh T. Le
(74) *Attorney, Agent, or Firm*—Slater & Matsil, L.L.P.

(57) ABSTRACT

A system and a method is disclosed for allowing bandgap circuitry to function on a low supply voltage integrated circuit, and for using the reference voltage (Vbg) generated by the bandgap circuitry to enable a reference voltage to control system voltage. An illustrative embodiment comprises a charge pump to raise a supply voltage to a system voltage, and an open loop controller, which provides a first signal to activate the charge pump, enabling a bandgap circuit, which outputs a bandgap voltage reference. Further, the system comprises a closed loop controller, which regulates the system voltage by comparing the system voltage to the bandgap reference voltage. Upon the system voltage falling below a target voltage, the closed loop controller provides a second signal to activate the charge pump. Additionally the system comprises a switch controller, which selects the closed loop controller upon sensing the bandgap circuit is active.

20 Claims, 6 Drawing Sheets

LOW SUPPLY VOLTAGE BANDGAP SYSTEM

TECHNICAL FIELD

The present invention relates generally to an integrated circuit, and more particularly to a system and a method for allowing bandgap circuitry to provide a reference voltage for a low supply voltage integrated circuit.

BACKGROUND

In conventional DRAM arrays, information is stored in a given DRAM cell by driving a wordline (WL) appropriately to activate a transfer transistor, and thereby transfer charge into the cell capacitor. In general, the retention time of the cell, and the performance of the cell, increases with the amount of charge transferred to the cell. The transfer transistor of a given cell is activated for transferring charge into the cell by application of a voltage Vpp to the wordline, and the transfer transistor is switched off by application of a voltage wordline low (WLL) to the wordline.

In order to transfer the maximum possible charge to the cell, Vpp must be greater than the threshold voltage Vt of the transfer transistor. Therefore, Vpp may be the sum of the voltage supply (Vdd) and the transistor threshold voltage (Vtn). Increases in the Vpp voltage permit reductions in the charge transfer time. However, due to reliability concerns, the maximum Vpp is limited due to the maximum allowable electric field across the gate oxide of the transfer transistor. The Vpp voltage may be regulated to assure the gate oxide of the transfer transistor is not damaged. A reference voltage such as a bandgap circuit may produce may be used to aid in this voltage regulation.

A bandgap circuit generates a fixed dc reference voltage that does not change with temperature. A bandgap circuit is based on adding two voltages whose temperature coefficients have opposite signs. With steadily decreasing power supply voltages in CMOS technologies, the design of voltage/current references becomes more difficult. The traditional voltage summing bandgap reference circuit is not suited for a CMOS technology with a maximum supply voltage of 1.0V or less. The value of bandgap voltage in silicon (1.12V) is close to or exceeds the maximum supply voltage admissible in the technology. This causes bandgap circuitry to fail.

SUMMARY OF THE INVENTION

This and other problems are generally solved or circumvented, and technical advantages are generally achieved, by illustrative embodiments of the present invention, which provide a system enabling a closed loop controller to regulate a system voltage by using a bandgap voltage as a reference. One embodiment of such a system comprises a charge pump to raise a supply voltage to a system voltage, an open loop controller, which provides a first signal to activate the charge pump, and a bandgap circuit, which outputs a bandgap voltage reference. Further, the system comprises a closed loop controller, which regulates the system voltage by comparing the system voltage to the bandgap reference voltage. When the system voltage falls below a target voltage, the closed loop controller provides a second signal to activate the charge pump. Additionally the system comprises a switch controller, which selects the closed loop controller upon sensing the bandgap circuit is active.

An advantage of an illustrative embodiment of the present invention is that the system may be a low supply voltage integrated circuit with a logic process core voltage of one volt or less. A further advantage of an illustrative embodiment of the present invention is to prevent system feedback self-lock problems, in that the initial Vpp rough voltage level is provided by a simple control detector.

Yet another advantage of an illustrative embodiment of the present invention is that once the Vpp level power is up and stable enough for the bandgap operation, the bandgap circuit will provide a more precise level detection control to enable accurate DRAM WL voltage operation. The bandgap circuitry may also serve as a reference to regulate other voltages such as, for example, a $V_{bb}$ of −0.50 V.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures or processes for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF ILLUSTRATIVE EMBODIMENTS

The making and using of the presently preferred embodiments are discussed in detail below. It should be appreciated, however, that the present invention provides many applicable inventive concepts that can be embodied in a wide variety of specific contexts. The specific embodiments discussed are merely illustrative of specific ways to make and use the invention, and do not limit the scope of the invention.

The present invention will be described with respect to preferred embodiments in a specific context, namely an eDRAM system, which may have a logic process core voltage of one volt or below. The invention may also be applied, however, to other integrated circuits with supply voltages lower than the operational voltage for a bandgap circuit.

An example of an illustrative embodiment of the inventive system is implemented in an eDRAM cell. The embodiment allows bandgap circuitry to function on a low boosted wordline voltage (Vpp) integrated circuit, and for using the reference voltage (Vbg) generated by the bandgap circuitry to enable a feedback process to regulate Vpp system voltage. In an illustrative embodiment, a switch controller detects the functional bandgap circuit and enables a closed-loop controller to control the operation of a Vpp charge pump. The closed-loop controller may send signals to the charge pump when the Vpp system voltage is less than a Vpp system voltage target. When the Vpp system voltage is equal to or greater than the Vpp target voltage, the switch controller enables a closed-loop controller to control the operation of the Vpp charge pump to regulate the Vpp system voltage.

Further, the illustrative embodiments provide a system and a method to regulate a Vbb system voltage. A Vbb system is used for WL turn on voltage supply for PMOS passgate and a WL turn off voltage supply for NMOS passgate on an eDRAM cell. A typical voltage level for a Vbb system voltage is about −0.5 V.

Figure 1:
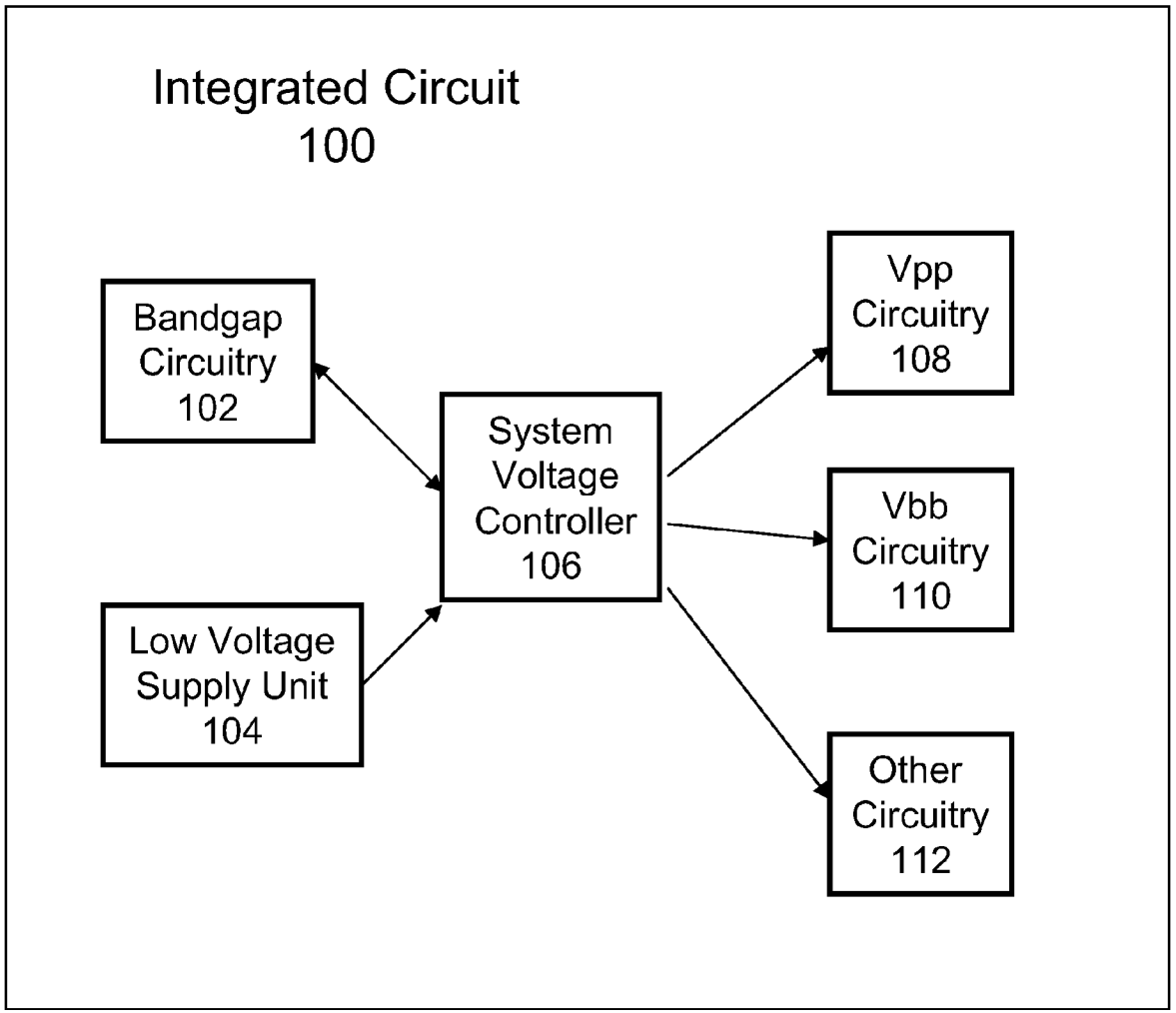
FIG. 1 is a top-level block diagram of a low supply voltage integrated circuit.

FIG. 1 is a top-level block diagram of a low supply voltage integrated circuit. Integrated circuit 100 includes bandgap circuitry 102, low voltage supply unit 104, which may or may not be within integrated circuit 100, system voltage controller 106, Vpp circuitry 108, Vbb circuitry 110, and other circuitry 112.

Bandgap circuitry 102 is a voltage reference circuit used in integrated circuits, usually with an output voltage around 1.25 V, close to the theoretical bandgap of silicon at 0 K. One example of how a bandgap circuit may work is that the voltage difference between two diodes, often operated at the same current and of different junction areas, is used to generate a proportional to absolute temperature (PTAT) current in a first resistor. This current is used to generate a voltage in a second resistor. This voltage in turn is added to the voltage of one of the diodes (or a third one, in some implementations). The voltage across a diode operated at constant current, or here with a PTAT current, is complementary to absolute temperature (CTAT). If the ratio between the first and second resistor is chosen properly, the first order effects of the temperature dependency of the diode and the PTAT current will cancel out. The resulting voltage is about 1.2-1.3 V, depending on the particular technology, and is close to the theoretical bandgap of silicon at 0 K. The remaining voltage change over the operating temperature of typical integrated circuits is on the order of a few millivolts. This temperature dependency has a typical parabolic behavior. The principle in bandgap circuitry 102 is to balance the negative temperature coefficient of a pn junction with the positive temperature coefficient of the thermal voltage. Bandgap circuitry is well known in the art and the scope of the illustrative embodiments include any bandgap circuitry and is not limited by the preceding description. Since the output voltage is fixed around 1.25 V for typical bandgap reference circuits, the minimum operating voltage of a bandgap circuit is about 1.4 V.

Upon initiating or applying power to integrated circuit system, system voltage controller 106 pumps up the low supply voltage from low voltage supply unit 104 to a rough system voltage level that is sufficient to operate bandgap circuitry 102. This is termed "open loop control." After bandgap circuitry 102 is operational, system voltage controller 106 detects the functional bandgap circuitry 102 and selects a closed loop circuit control. This is termed "closed loop control." Closed loop control more precisely regulates the system voltage than open loop control by using the bandgap reference voltage generated by bandgap circuitry 102 to control the system voltage. Vpp circuitry 108, Vbb circuitry 110, and other circuitry 112 may require different voltage levels for proper operation. System voltage controller 106 may optionally have the capability to compare and regulate a range of voltages appropriate for a range of circuitry. System voltage controller 106 may regulate voltages from −1.5V to 1.5V.

Figure 2:
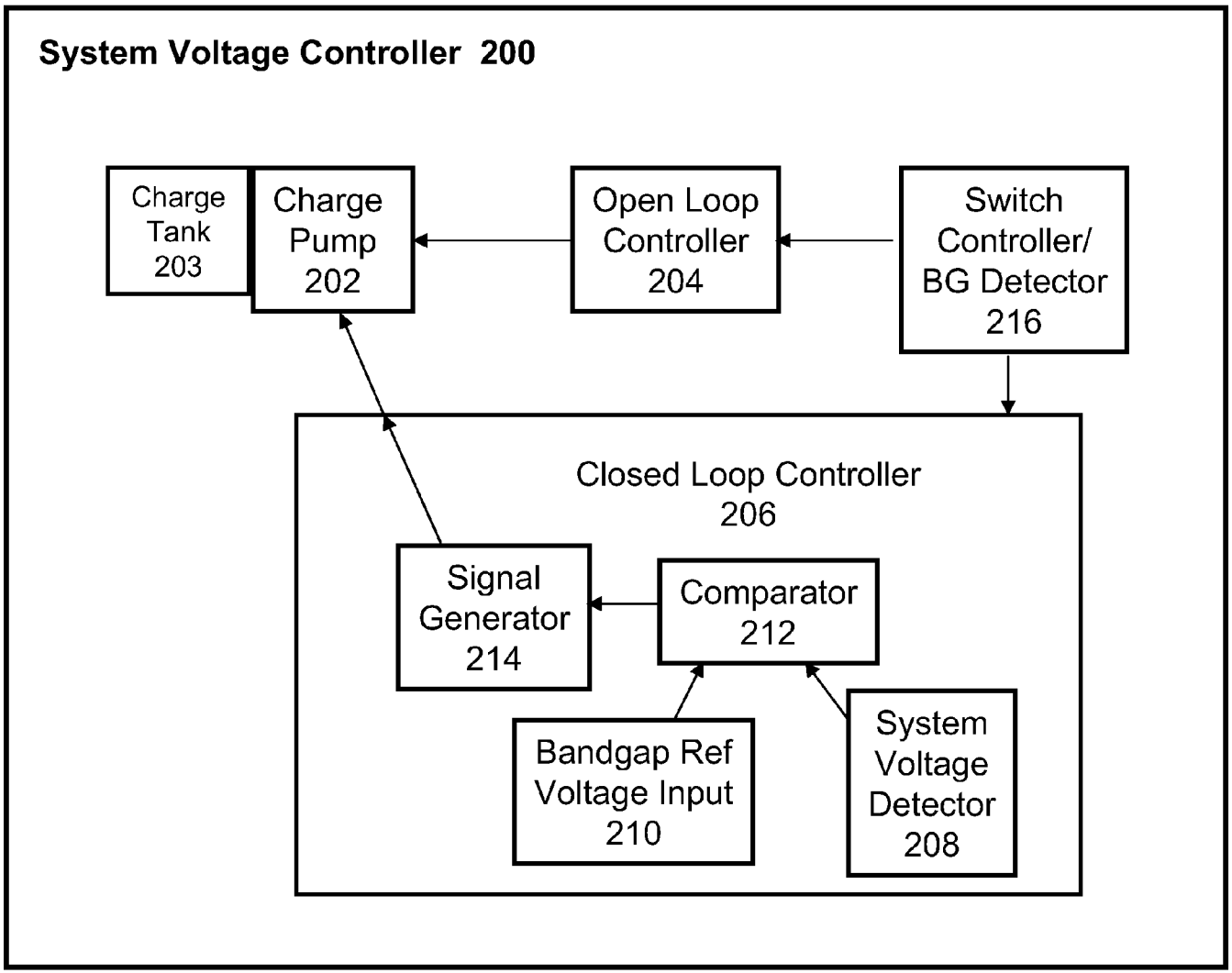
FIG. 2 is a block diagram of a system voltage controller, such as system voltage controller 104 of FIG. 1.

FIG. 2 is a top-level block diagram of the system voltage controller, such as system voltage controller 106 in FIG. 1. System voltage controller 200 shows charge pump 202. Charge pump 202 may use capacitors, switches, and a charge tank to create a higher voltage source than the supply voltage. A charge pump is an electronic circuit that uses capacitors as energy storage elements to create either a higher or lower voltage power source. Charge pump circuits may be electrically simple circuits. Charge pumps may use some form of switching device(s) to control the connection of voltages to the capacitor. For instance, to generate a higher voltage, the first stage involves the capacitor being connected across a voltage and charged up. In the second stage, the capacitor is disconnected from the original charging voltage and reconnected with its negative terminal to the original positive charging voltage. Because the voltage across the positive terminal of the capacitor is retained, the positive terminal voltage is added to the original voltage.

Open loop controller 204 regulates the system voltage upon system initiation. Open loop controller 204 sends signals to charge pump 202 causing charge pump 202 to operate continuously. System voltage controller 200 also has closed loop controller 206. Closed loop controller 206 regulates the system voltage more precisely than open loop controller 204. Closed loop controller 206 detects the system voltage and uses the bandgap reference voltage output from the bandgap circuitry, such as bandgap circuitry 102 in FIG. 1, as a reference to determine if the system voltage is different from the system voltage target. If closed loop controller 206 detects a system voltage lower than the voltage target, one or more signals may be sent to activate charge pump 202. Optionally, the closed loop controller 206 may send signals to deactivate the charge pump 202 if the system voltage is greater than the system voltage target.

Additionally, system voltage controller 200 includes switch controller 216. Upon system initiation, open loop controller 204 is selected. Initially the bandgap circuitry, such as bandgap circuitry 102 in FIG. 1 may not function because the supply voltage from a low voltage supply unit, such as low voltage supply unit 104 of FIG. 1, is insufficient. As the system voltage increases, the switch controller 216 detects when the bandgap circuitry becomes functional, and the bandgap circuitry is therefore able to supply the bandgap reference voltage to closed loop controller 206, through bandgap reference voltage input 210. Upon detecting a functional bandgap circuit, switch controller 216 selects closed loop controller 206 and deselects open loop controller 204.

During an initial operation of an integrated circuit, such as integrated circuit 100 in FIG. 1, open loop controller 204 sends pulses to charge pump 202, which signal charge pump 202 to run continuously. This system may be termed "open looped pulse train generator". When the system voltage is elevated to a level at which the bandgap circuitry can function, switch controller 216 sends a signal to select closed loop controller 206. Switch controller 216 then switches the open loop controller 204 out of the circuit and connects the closed loop controller 206 into the circuit. The closed loop controller 206 uses comparator 212 to compare Vbg, the voltage produced by bandgap circuitry 202, as a reference voltage for the system voltage. As system voltage detector block 208 senses a system voltage that is lower than a system voltage target, signal generator 214 sends pump activation control pulses to charge pump 202. If system voltage detector 208 senses a system voltage that is higher than a system voltage target, charge pump 202 is instructed not to pump.

Figure 3:
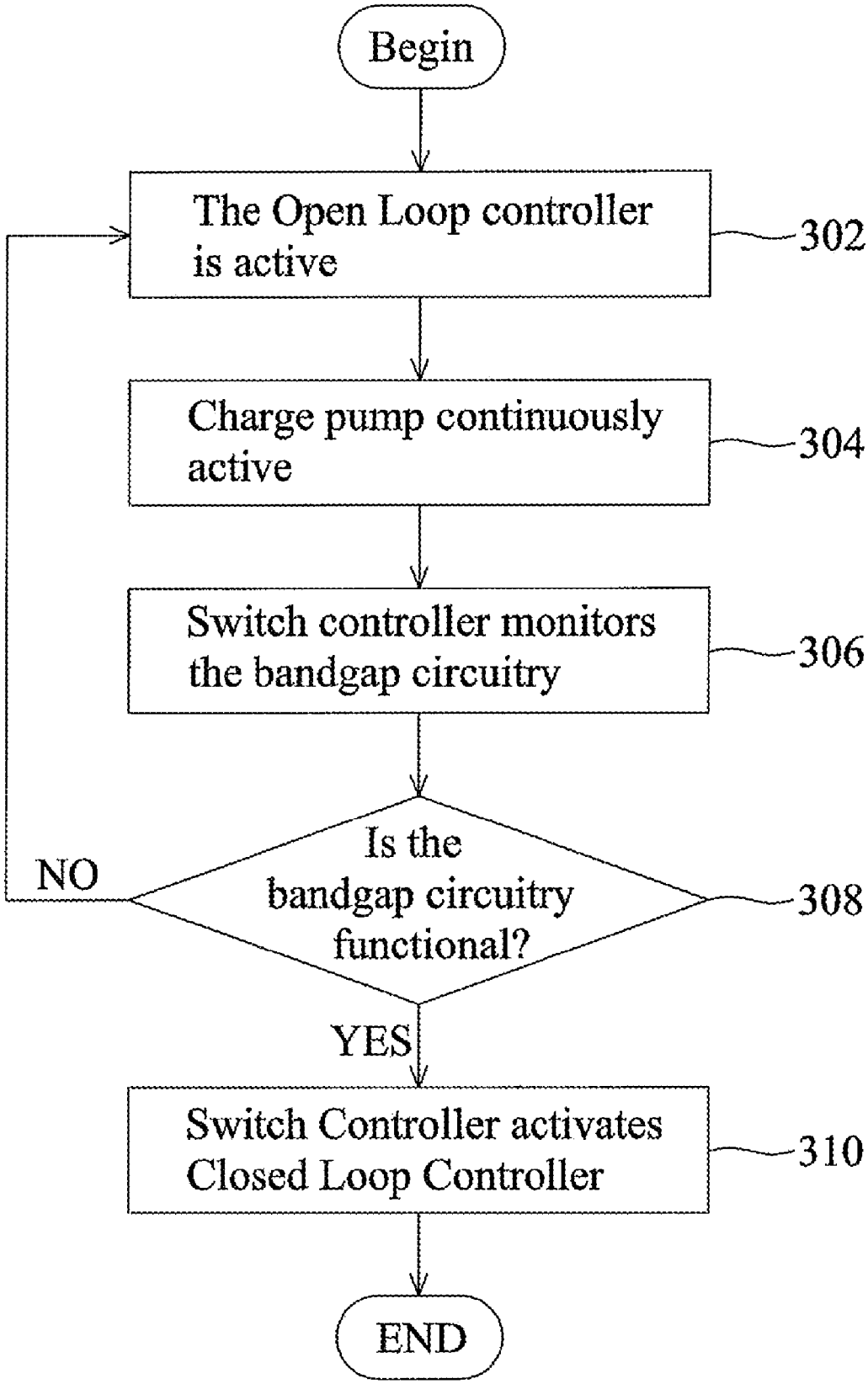
FIG. 3 is a top-level flow chart for a system voltage controller.

FIG. 3 is a top-level flow chart for a system voltage controller. The flow begins with an open loop controller, such as open loop controller 204 in FIG. 2, active (step 302). The active open loop controller uses a signal generator, such as signal generator 214 in FIG. 2 to send activation signals to the charge pump. Therefore, the charge pump, such as charge pump 202 in FIG. 2, is continually active (step 304). Bandgap circuitry, such as bandgap circuitry 102 in FIG. 1, attempts to operate. A switch controller, such as switch controller 216 in FIG. 2, monitors the bandgap circuitry (step 306). The switch controller determines whether the bandgap circuitry is operational (step 308). If the bandgap circuitry is not operational (no to the output of step 308), then the system continues to operate an active open loop controller (process returns to step 302). If the bandgap circuitry is operational (yes to the output of step 308) then the switch controller deselects the open loop controller and selects the closed loop controller (step 310).

Figure 4:
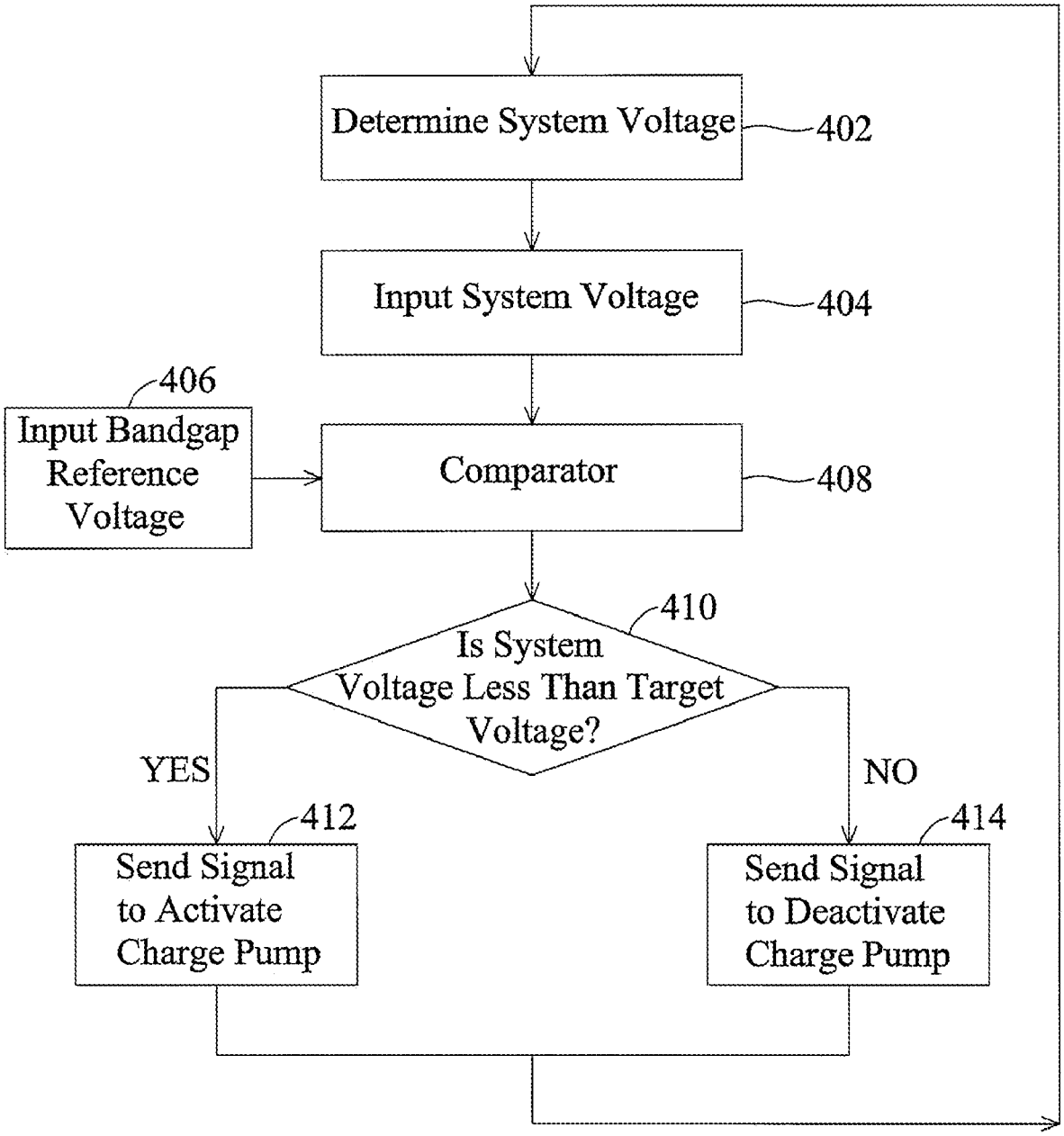
FIG. 4 illustrates the closed loop operation of the system voltage controller.

Turning now to FIG. 4, the closed loop operation of the system voltage controller is illustrated. Bandgap circuitry, such as bandgap circuitry 102 in FIG. 1, is operational if the system voltage controller is operating in closed loop mode as illustrated. A system voltage detector, such as system voltage detector 208 in FIG. 2, detects the system voltage (step 402). A comparator, such as comparator 212 in FIG. 2, accepts the input of the system voltage (step 404). The comparator also accepts the bandgap reference voltage (step 406). The bandgap reference voltage, produced by the bandgap circuitry is input through a bandgap reference voltage input such as bandgap reference voltage input 210, in FIG. 2. The comparator then compares (step 408) the system voltage to the bandgap reference voltage. If the system voltage is less than a system voltage target (yes output to step 410) a signal generator, such as signal generator 214 in FIG. 2 sends a signal to activate the charge pump (step 412). If the system voltage is more than a system voltage target (no output to step 410) the signal generator sends a signal to deactivate the charge pump (step 414). Other embodiments may signal the charge pump in other ways, for example, the charge pump may be deactivated by stopping the activation signals sent by a signal generator. Any control of the charge pump is within the scope of the illustrative embodiments. The closed loop mode of the system voltage controller provides a more finely tuned system voltage; however, the voltage may remain cyclical due to the cycling of the charge pump.

Figure 5:
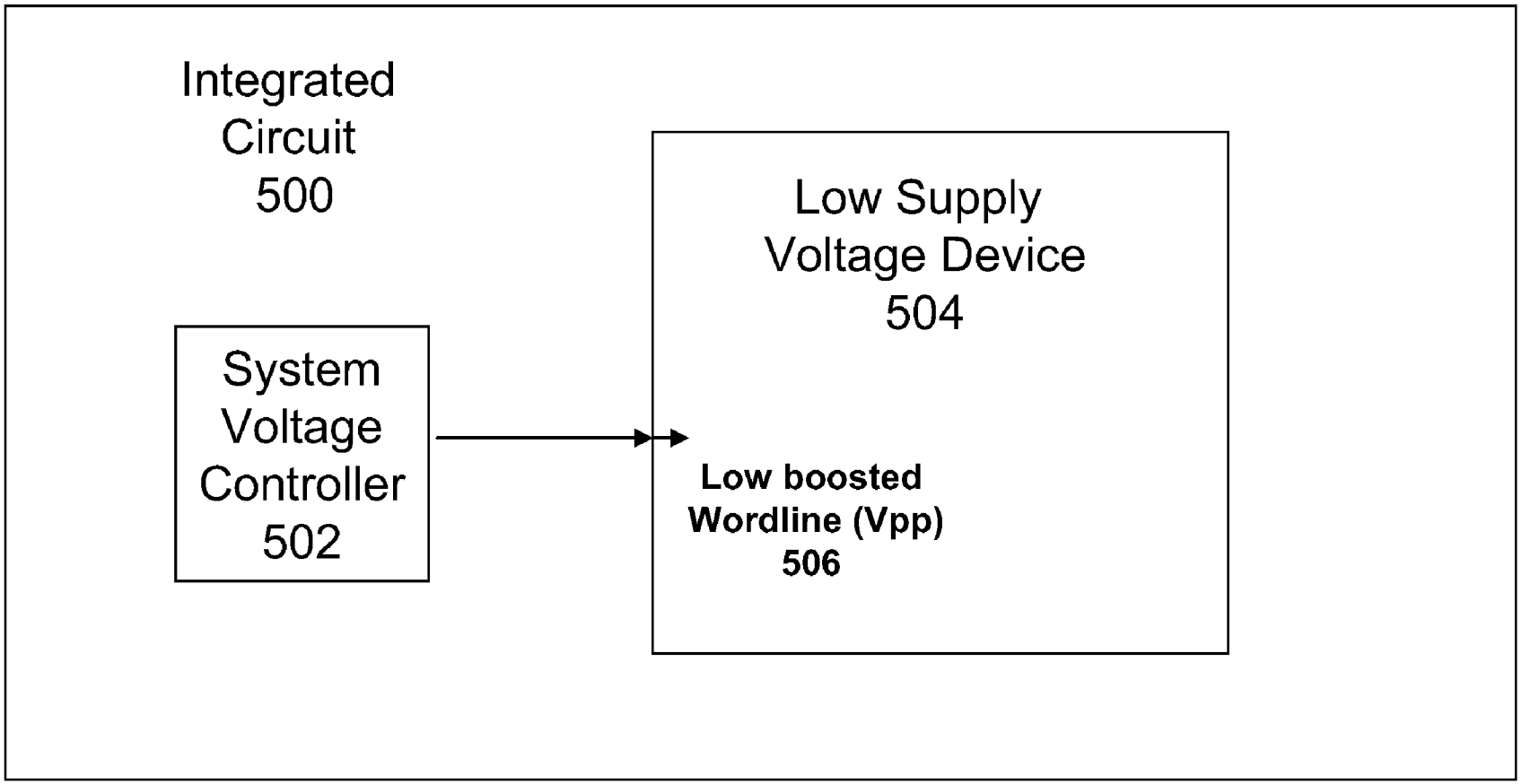
FIG. 5 shows an integrated circuit with a low supply voltage device embedded.

Turning now to FIG. 5, integrated circuit 500 is shown with low supply voltage device 504. Low supply voltage device 504 may have on operating voltage greater than the supply voltage of the device. System voltage controller 502, such as system voltage controller 106 in FIG. 1, provides a boosted operating voltage to low supply voltage device 504 through low boosted wordline (Vpp) 506. System voltage controller 502 outputs the boosted system voltage to low boosted wordline 506 on low supply voltage device 504. The boosted system voltage is the target operating voltage for low supply voltage device 504.

Figure 6:
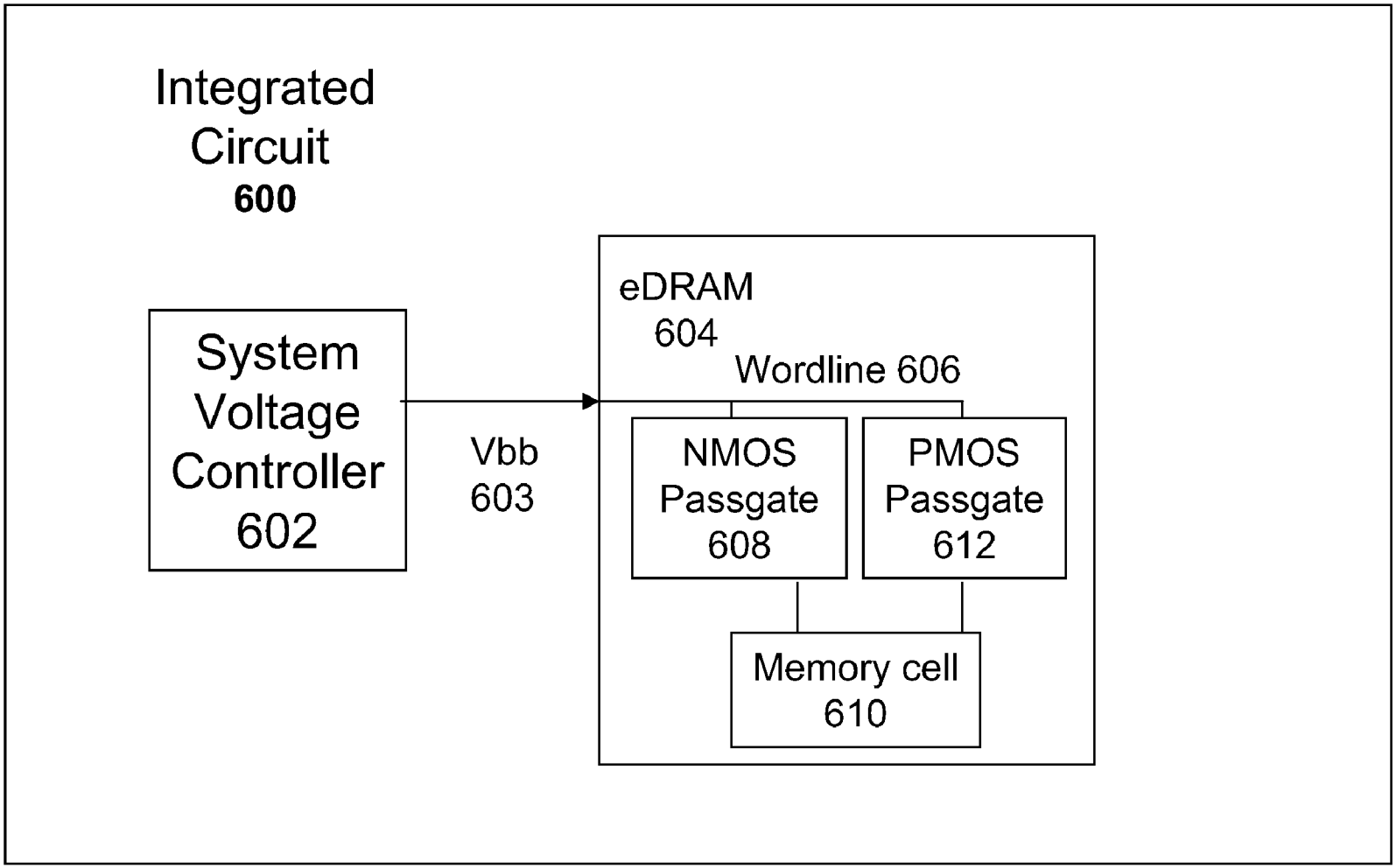
FIG. 6 shows an integrated circuit with an embedded eDRAM.

FIG. 6 illustrates integrated circuit 600 with embedded eDRAM 604. eDRAM 604 comprises wordline 606, NMOS passgate 608, PMOS passgate 612, and memory cell 610. System voltage controller 602 provides Vbb voltage 603 to wordline 606. A Vbb system may be used for a wordline turn on voltage supply for a PMOS passgate and a wordline turn off voltage supply for an NMOS passgate on an eDRAM cell. A typical voltage level for a Vbb system voltage is about −0.5 V.

Those of ordinary skill in the art will recognize that there are other methods to increase or pump a voltage and these methods are within the scope of the illustrative embodiments of the present invention.

Although the present invention and its advantages have been described in detail, it should be understood that various changes, substitutions, and alterations can be made herein without departing from the spirit and scope of the invention as defined by the appended claims. It will be readily understood by those skilled in the art that voltage levels may be varied while remaining within the scope of the present invention.

Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. An integrated circuit system comprising:

a charge pump to raise a supply voltage to a system voltage;

an open loop controller, wherein the open loop controller provides a first signal to activate the charge pump;

a bandgap circuit, wherein the bandgap circuit outputs a bandgap reference voltage;

a closed loop controller, wherein the closed loop controller regulates the system voltage by comparing the system voltage to the bandgap reference voltage and a target voltage, wherein upon the system voltage falling below the target voltage, the closed loop controller provides a second signal to activate the charge pump; and a switch controller comprising a bandgap voltage detector, wherein the switch controller selects the closed loop controller upon sensing the bandgap circuit is active.

2. The system of claim 1, wherein the supply voltage is lower than an operating voltage of the bandgap circuit.

3. The system of claim 1, wherein the open loop controller is selected upon applying power to the system.

4. The system of claim 1, wherein the supply voltage is about 1V or less.

5. The system of claim 1, wherein the system voltage is in the range of about −1.5V to about +1.5V.

6. The system of claim 1, wherein the target voltage is about (supply voltage +0.5V).

7. The system of claim 1, wherein the target voltage is about (supply voltage −1.5V).

8. The system of claim 1, wherein the system voltage is an operating voltage for a low boosted wordline voltage (Vpp) on a low supply voltage device.

9. The system of claim 1, wherein the system voltage is a Vbb voltage, wherein the Vbb voltage is used for wordline (WL) turn on voltage supply for a PMOS passgate and wherein the Vbb voltage is used for WL turn off voltage supply for an NMOS passgate in an eDRAM cell.

10. An integrated circuit system comprising:

a Vpp charge pump, wherein the Vpp charge pump boosts a supply voltage to form a system voltage;

a Vpp tank, wherein the Vpp tank stores charge from the Vpp charge pump;

an open loop controller, which sends signals to the Vpp charge pump;

bandgap circuitry for producing a bandgap voltage (Vbg);

a bandgap voltage detector which detects the Vbg;

a Vpp level controller, wherein the Vpp level controller acts as a closed loop controller, which sends closed loop signals to the Vpp charge pump;

a switch between the open loop controller and a the Vpp level controller, wherein the switch is controlled by the bandgap voltage detector;

a system voltage detector, which informs the Vpp level controller of the system voltage; and a comparator, which compares the system voltage to the Vbg, wherein the Vpp level controller uses a comparison between the system voltage to the Vbg to determine whether to send closed loop signals to the Vpp charge pump.

11. The system of claim 10, wherein the supply voltage is lower than an operating voltage of the bandgap circuit.

12. A method of operating an integrated circuit system comprising:

pumping a supply voltage to a target system voltage using a charge pump;

generating an open loop signal, wherein an open loop controller sends pump signals to the charge pump during an open loop operation;

producing a bandgap reference voltage (Vbg) using bandgap circuitry;

detecting functional bandgap circuitry in a switch controller;

switching between the open loop operation and a closed loon operation, wherein the switching is controlled by the switch controller;

informing a closed loon controller of a system voltage;

determining by comparing the Vbg and the system voltage in the closed loop controller whether to boost the system voltage to achieve the target system voltage; and generating a closed loop signal in the closed loop controller, wherein the closed loop controller sends signals to the charge pump during the closed loop operation to boost the system voltage.

13. The method of claim 12, wherein the supply voltage is lower than an operating voltage of the bandgap circuitry.

14. The method of claim 12, wherein the open loop controller is selected upon applying power to the integrated circuit system.

15. The method of claim 12, wherein the supply voltage is about 1V or less.

16. The method of claim 12, wherein the system voltage is in the range of about −1.5V to about +1.5V.

17. The method of claim 12, wherein the target system voltage is about (supply voltage +0.5V).

18. The method of claim 12, wherein the target system voltage is about −0.5V.

19. The method of claim 12, wherein the system voltage is an operating voltage for a low boosted wordline voltage (Vpp) on a low supply voltage device.

20. The method of claim 12, wherein the system voltage is a Vbb voltage, wherein the Vbb voltage is used for wordline (WL) turn on voltage supply for a PMOS passgate and wherein the Vbb voltage is used for WL turn off voltage supply for an NMOS passgate in an eDRAM cell.

* * * * *

UNITED STATES PATENT AND TRADEMARK OFFICE

CERTIFICATE OF CORRECTION

PATENT NO. : 7,557,642 B2
APPLICATION NO. : 11/845628
DATED : July 7, 2009
INVENTOR(S) : Hsu et al.

It is certified that error appears in the above-identified patent and that said Letters Patent is hereby corrected as shown below:

On title page, item (75) Inventors, delete "Len" and insert --Lan--.
In Col. 7, line 4, after and delete "a".
In Col. 7, line 28, delete "loon" and insert --loop--.
In Col. 7, line 30, delete "loon" and insert --loop--.

Signed and Sealed this

Eighteenth Day of August, 2009

David J. Kappos

David J. Kappos
*Director of the United States Patent and Trademark Office*